US007350242B2

(12) United States Patent
Girod

(10) Patent No.: US 7,350,242 B2
(45) Date of Patent: Apr. 1, 2008

(54) GARMENTS HAVING AN INSIDE OUT APPEARANCE

(76) Inventor: Elizabeth M. Girod, 8111 Taunton Rd., Indianapolis, IN (US) 46260

( * ) Notice: Subject to any disclaimer, the term of this patent is extended or adjusted under 35 U.S.C. 154(b) by 0 days.

(21) Appl. No.: 11/429,036

(22) Filed: May 5, 2006

(65) Prior Publication Data

US 2007/0266478 A1 Nov. 22, 2007

(51) Int. Cl.
*A41D 1/06* (2006.01)
*A41D 27/20* (2006.01)

(52) U.S. Cl. ..... 2/227; 2/236; 2/247

(58) Field of Classification Search ..... 2/227, 2/234–236, 247, 265, 275, DIG. 2
See application file for complete search history.

(56) References Cited

U.S. PATENT DOCUMENTS 1,982,996 A * 12/1934 Levine ..... 2/234
2,759,192 A * 8/1956 Levi ..... 2/227
3,234,564 A * 2/1966 Chujfi ..... 2/227
3,425,062 A * 2/1969 Chujfi ..... 2/227
D333,203 S * 2/1993 Jones ..... D2/738
5,204,995 A * 4/1993 Knapp ..... 2/228
5,359,950 A * 11/1994 Schellas ..... 112/417
D421,674 S * 3/2000 King ..... D2/750
D428,548 S 7/2000 Hosogai
D430,385 S 9/2000 Hosogai
6,182,296 B1 * 2/2001 Hosogai ..... 2/227
D439,727 S 4/2001 Hosogai
6,243,878 B1 * 6/2001 Khemka et al. ..... 2/227
D459,055 S 6/2002 Hosogai
6,647,551 B2 * 11/2003 Palumbo ..... 2/69
D485,049 S * 1/2004 Newson ..... D2/742
D543,007 S * 5/2007 Beckerman ..... D2/717
2006/0032875 A1 * 2/2006 Patterson ..... 224/153
2006/0107441 A1 * 5/2006 Houdroge ..... 2/227

OTHER PUBLICATIONS http://web.archive.org/web/20010801155846/http://ohioline.osu.-edu/hyg-fact/5000/5541.html; Ohio State University Extension Fact Sheet—Texiles and Clothing; Selecting Jeans, pp. 1-5; as of Aug. 1, 2001.*
http://ohioline.osu.edu/hyg-fact/5000/5541.html; Ohio State Universoty Extension Fact Sheet—Textiles and Clothing; Selecting Jeans, pp. 1-5; as of Sep. 7, 2007.*
http://www.thetshirtpeople.com/Fabric?index.html; The T-shirt People; Fabric Glossary; p. 1-7; as of Aug. 28, 2007.*
http://www.cone.com/us/denim/crjeans.htm;—Last Accessed: Sep. 8, 2005.

* cited by examiner

*Primary Examiner*—Gary L. Welch
*Assistant Examiner*—Jena A Sold
(74) *Attorney, Agent, or Firm*—Woodard, Emhardt, Moriarty, McNett & Henry LLP

(57) ABSTRACT

Garments having an inside-out appearance are disclosed and are designed to be inside-out and fashionable. Unique fasteners, belt carriers and modifications of pockets make possible wearing a garment having an inside-out appearance. When a conventional garment is turned inside out many features such as belt carriers, zippers, and pockets become difficult or impossible to use when the garment is worn. Garments disclosed herein permit full use of features such as belt carriers, buttons, zippers, and pockets.

23 Claims, 3 Drawing Sheets

GARMENTS HAVING AN INSIDE OUT APPEARANCE

FIELD OF THE INVENTION

The present invention generally relates to clothing, and more particularly to garments having an inside-out appearance.

BACKGROUND OF THE INVENTION

Garments can be made using many different fabric types and can come in a variety of styles. Fabrics used in garments often have a so-called right side and a so-called wrong side, the right side indicating the side of the fabric normally shown on the outside of the garment when worn and the wrong side indicating the side normally hidden from view.

When making a garment, the fabric can be laid out and pattern pieces can be cut from the fabric. Multiple pattern pieces of various sizes and shapes can be created from the fabric, usually by cutting the fabric along a predetermined path. The pattern pieces are used to create the shape of the garment by attaching the pattern pieces together at predefined locations. A variety of attachment mechanisms can be used, including numerous stitching techniques, as is known in the art.

As mentioned above, garments are usually created with the right side of the fabric displayed on the outside of the garment. Fasteners are used on the garment to facilitate wearing and are oriented to encourage wear of the garment wherein the right side of the fabric is shown on the outside of the garment. Some fasteners useful in wearing garments include buttons, zippers, and belt carriers. Any given garment can be made having a combination of various fasteners.

Some garments can also be made having a number of functional elements such as pockets and belt carriers. Pockets can be made having a number of different configurations, such as a panel pocket, pocket bag, and coin pocket. The pockets can be attached by sewing and/or or can be riveted. Likewise, belt carriers can be sewn, stitched or otherwise attached to add to the functionality or appearance of the garment.

When a garment is turned inside-out it can become difficult to continue full use of the garment. For example, in some garments fasteners are meant to be used when a person wears the garment conventionally and are not intended to be functional when the garment is worn inside-out. Likewise, features such as pockets or belt carriers can be difficult or impossible to fully use when the garment is worn inside out. Because of this, it can sometimes be difficult to properly wear a garment inside-out.

In view of this background, the need remains for garments intended to be worn with an inside out appearance. The present invention is addressed to these needs.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying figures forming a part thereof.

DETAILED DESCRIPTION

Figure 1B:
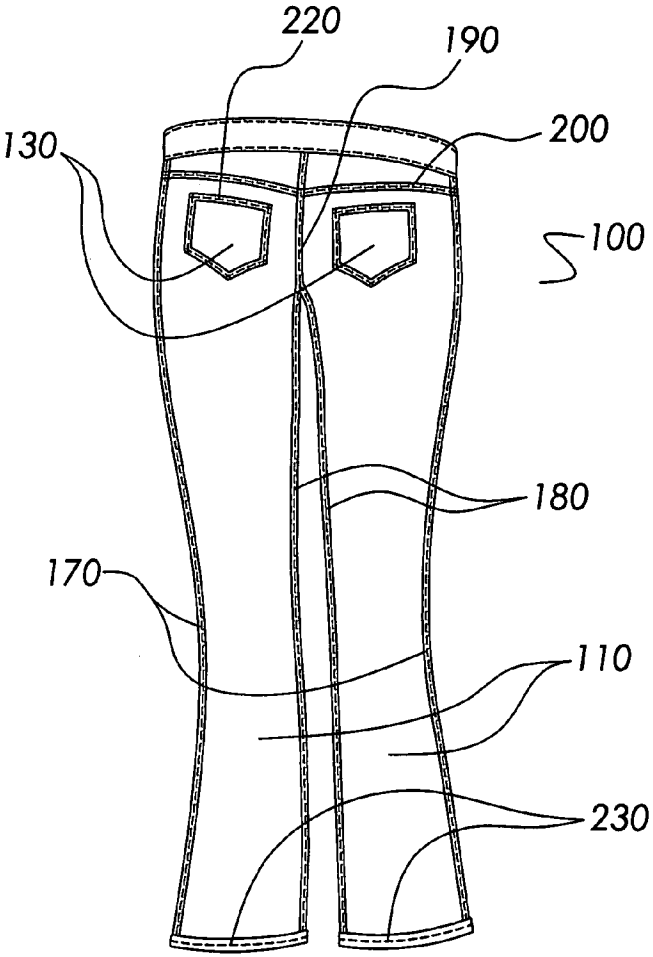
FIG. 1*b* depicts the back view of a pair of pants.

For the purposes of promoting an understanding of the principles of the invention, reference will now be made to the embodiments illustrated in the drawings and specific language will be used to describe the same. It will nevertheless be understood that no limitation of the scope of the invention is thereby intended, and alterations and modifications in the illustrated devices, and further applications of the principles of the invention as illustrated therein are herein contemplated as would normally occur to one skilled in the art to which the invention relates.

Certain embodiments of the present invention provide novel arrangements of garments having an inside out appearance and/or provide for inside-out fashion. Furthermore, certain embodiments of the present invention provide an aesthetic appearance and feel which are pleasing to some people and can be unisex or designed specifically for men, women, or children. Novel approaches to providing fasteners on the wrong side of fabric on the outside of garments provide useful garments having an inside-out appearance. As used herein, the term 'garments' includes but is not limited to pants, slacks, jeans, shirts, blouses, skirts, jackets and hats. Also as used herein, the term 'fasteners' includes but is not limited to buttons, rivets, zippers, hooks, hook and loop fasteners sometimes referred to as VELCRO, snaps, and belt carriers.

Figure 1A:
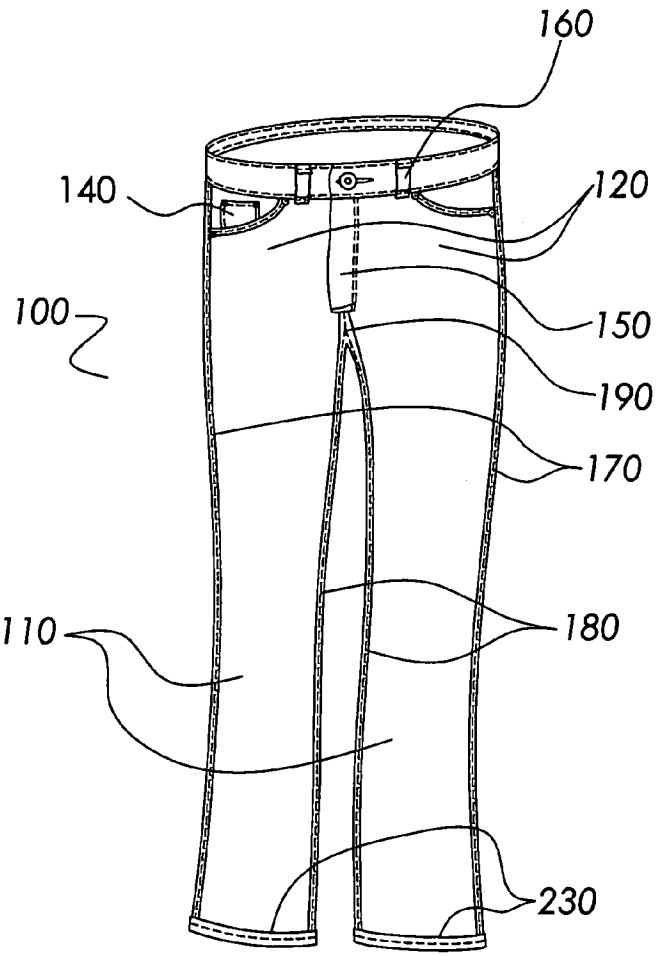
FIG. 1*a* depicts the front view of a pair of pants.

Turning now to FIGS. 1*a* and 1*b*, a pair of pants 100 is shown having the appearance of a conventional pair of pants which have been turned inside-out. Pants 100 of the illustrated embodiment are constructed from conventional denim fabric. In other embodiments, however, the pants or other garments may be formed from another fabric type. As used herein, the term 'fabric' includes but is not limited to woven or knitted fabrics such as denim, duck cloth, cotton and cotton blends, corduroy, velveteen, linen and linen blends, wool and wool blends, double knits and canvas. Many of these fabrics include a "right" side and a "wrong" side, wherein the right side is intended for external display while the wrong side is intended to be on the inside of a garment or otherwise covered so that the wrong side is not normally visible when the garment is worn in a conventional fashion. For example, twill fabrics, which include denim, generally comprise a plurality of warp yarns and a plurality of weft yarns interwoven such that the weft yarns are prominent on one side while the warp yarns are prominent on the opposite side. Many twill fabrics use dyed warp yarns to contrast with the weft yarns to create a desired appearance. Such fabrics have a different appearance on each side of the fabric as the warp and weft yarns each predominate on opposite sides.

Pants 100 are constructed such that the right side of the fabric faces the inside of pants 100. For example, if pants 100 were constructed of a twill fabric, as discussed above, then the side of the fabric where the warp yarns predominate (conventionally the right side) would face the inside of pants 100 while the side of the fabric where the weft yarns predominate (wrong side) would face outwardly and be visible when pants 100 are worn. Additionally, the seams facing the inside of the pants 100 appear as they would appear on the outside of a conventional pair of pants. As used herein, 'conventional pair of pants' and 'conventional pair of jeans' is intended to encompass a pair of pants such as standard jeans and DOCKERS manufactured by LEVI STRAUSS that are constructed using the right side of fabric showing on the outside of the pants, as is well known in the art. Also as used herein, the term 'conventional garment' means a garment that is constructed using the right side of fabric showing on the outside of the garment. The pants 100 are also constructed such that the wrong side of a majority of the fabric faces the outside of the pants, giving the pants 100 the appearance of being inside out even though they are not.

Pants 100 include features similar to conventional pants such as pant legs 110, front pockets 120, back pockets 130, coin pocket 140, fly guard 150 and belt carriers 160. Some of these features such as coin pocket 140 and belt carriers 160 are attached to the outside of pants in the illustrated embodiment to add functionality and usability even though the pants provide the illusion of being inside-out. If the pants 100 were merely conventional pants turned inside out, these features would be situated on the inside of the pants 100. As used herein, the term 'attached' includes but is not limited to sewn, stitched, glued, and riveted. When pattern pieces are attached to one another a variety of seams can be created, some of which include flat felled seams and serged seams.

In the illustrated embodiment, side seams 170 are finished having serged seam stitching shown on the outside of pants 100, contrasted with a conventional pair of pants where the serged seam would be hidden on the inside of the pants. Constructing pants having the serged seam visible on the outside is useful in creating the illusion that a conventional pair of pants has been turned inside out.

In the illustrated embodiment the inseams 180, crotch seam 190 and back yoke seam 200 utilize a flat felled seam application. It will be understood that inseams 180, side seams 170, crotch seam 190 and back yoke seam 200 are created when two pattern pieces are attached together and thus can take on a variety of forms as discussed above. Thus, in other embodiments a crotch seam can be created using a serged seam application to name just one example. Likewise, a back yoke seam can be created by attaching pattern pieces using double chain stitching to name just one example.

Back pocket 130 is attached in an inside out manner to the outside of pants 100 to add functionality and usability. The use of back pockets in the illustrated embodiment can be contrasted with a conventional pair of pants that have been turned inside-out. When conventional pants are turned inside-out the back pockets would face the inside and thus be inaccessible to the wearer when the pants are worn. Embodiments of the present invention, however, provide for back pockets useable in a pair of pants having an inside-out appearance.

The pair of back pockets 130 in the illustrated embodiment are patch pockets attached with the wrong side of denim facing the outside of the pants 100. The inside-out illusion is thus maintained while at the same time maintaining the utility of back pockets. The back pocket hem 220 is turned away from pants 100 thus exposing the right side of the denim of back pocket 130. Exposing the right side of the fabric in the back pocket hem 220 is also useful to highlight the outline of back pocket 130 and provide visual contrast. The back pocket 130 is thus constructed the same way a back pocket on a conventional pair of jeans would be constructed, but it is attached to the pants 100 with the conventional inside of the pocket facing outward. Providing back pocket 130 as described in the illustrated embodiment is similar to removing a back pocket from a conventional pair of pants and reattaching the pocket to the pants. In other embodiments, back pocket hem 220 can be turned toward the inside of pants 100, much as the hem would be created on a conventional pair of pants.

To further create the appearance of an inside-out pair of pants, the pant leg hem 230 is turned toward the outside of pants 100 with the right side of the fabric showing. Exposing the right side of the fabric in the pant leg hem 230 is useful to, among other things, highlight the bottom of pant leg 110 as well as to provide visual contrast. Because the pant leg hem 230 is turned away from pants 100, pant leg hem 230 creates the illusion of having been created by simply turning a pair of conventional pants inside-out. The pant leg hem 230 is thus constructed the same way the pant leg hem on a conventional pair of jeans would be constructed, except that the hemmed material is turned to the outside of the pants 120 instead of the inside, as is done with conventional pants. In other embodiments, pant leg hem 230 can be turned toward the inside of pants 100, much as the pant leg hem would be created on a conventional pair of pants.

Figure 2:
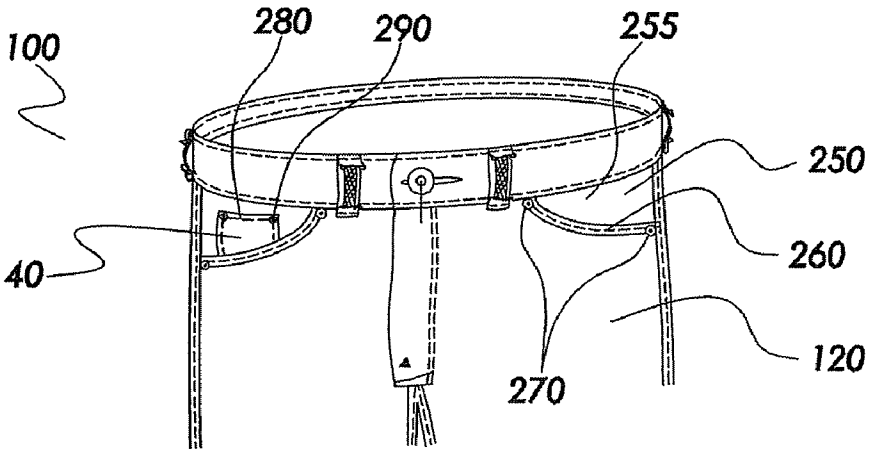
FIG. 2 depicts a close-up view of the top of the pair of pants of FIG. 1*a*.

Turning to FIG. 2 and examining the illustrated embodiment in more detail, pants 100 include a pair of front pockets 120 comprising front pocket bags 250 as found on the inside of a conventional pair of pants. Front pocket bags 250 may be constructed of a conventional pocket bag fabric having a different appearance than the fabric used to make the majority of pants 100. Front pocket bags 250 are depicted as partially showing on the outside of pants 100, the remainder of the bag is hidden from view much like a pocket bag of a conventional pair of pants. In a conventional pair of pants, the upper portion 255 of front pocket bag 250 would be concealed by a flap of fabric, typically matching the fabric from which the remainder of the pants 100 are constructed, as is known in the art. Allowing a portion of the front pocket bags to show at the top of the pocket 120 further reinforces the illusion that the pants 100 are inside out. In other embodiments, however, front pocket bags 250 can be attached similar to pocket bags in conventional jeans wherein the bag is hidden from view.

Front pocket hem 260 is formed at the top edges of the pocket 120 opening. Front pocket hem 260 is turned toward the inside of pants 100, much as the front pocket hem would be created on a conventional pair of pants. In other embodiments, front pocket hem 260 can be turned toward the outside of pants 100. Exposing the right side of the fabric in other embodiments is useful to, among other things, highlight the front pockets 120 as well as to provide visual contrast.

Front pocket rivets 270 are affixed to each end of front pocket hem 260 in the same areas where rivets are normally found on a conventional pair of jeans. As is known in the art, the front pocket rivets 270 comprise a rivet front and a rivet back which are mechanically coupled to one another with material thereby secured therebetween. Front pocket rivets 270 are attached in an inside out configuration wherein the back side of the rivet normally hidden from view on the inside of a conventional pair of pants is now shown on the outside of the illustrated embodiment. This effect can be created by actually riveting the pants with the rivet back on the outside of pocket 120 and the rivet front on the inside of pocket 120, or the rivet back may be on the inside pocket 120 and the rivet back may be on the outside of pocket 120 (i.e. the same orientation used in conventional pants), except that the rivet front is flipped over before securing it to the rivet back, such that the rear side of the rivet front faces outward from the outside of the pants 120. Placing rivets in the same orientation as conventional pants provides the protruding piece of the rivet to face out and provide maximum comfort and wear Because front pocket rivets 270 are attached backwards compared to a conventional pair of pants, the illustrated embodiment creates the illusion of having been created by turning a conventional pair of pants inside-out. In other embodiments, either the rivet front or the rivet back could be attached to the outside of pants 100 thus creating the impression that a rivet has been mechanically coupled.

Coin pocket 140 is sewn as a patch pocket and is attached to front pocket bag 250 with the wrong side of the fabric showing on the outside. The inside-out illusion is thus maintained while at the same time providing for the usefulness of coin pockets. Coin pocket hem 280 is turned away from the pants 120 thereby exposing the right side of the fabric on the outside. Exposing the right side of the fabric in the coin pocket hem 280 is useful to, among other things, highlight the outline of coin pocket 140 as well as to provide visual contrast. In other embodiments, coin pocket hem 280 can be turned toward the inside of pants 100, much as the coin pocket hem would be created on a conventional pair of pants. Coin pocket 140 is attached to pants using coin pocket rivets 290 attached to the top corners of coin pocket hem 280. Furthermore, three sides of coin pocket 140 are attached to pants 100 by stitching. In some embodiments, only one rivet may be used if only one corner of the top of the coin pocket were normally visible in any given design of pants 100.

Coin pocket rivets 290 are attached in an inside out configuration wherein the side of the rivet normally hidden from view on the inside of a conventional pair of pants is now shown on the outside of the illustrated embodiment, as discussed hereinabove with respect to the front pocket rivets 270. Because coin pocket rivets 290 are attached backwards compared to a conventional pair of pants, the illustrated embodiment creates the impression of having been created by turning a conventional pair of pants inside-out. Coin pocket rivets can be oriented similar to front pocket rivets discussed above. The coin pocket 140 is thus constructed the same way a coin pocket on a conventional pair of jeans would be constructed, but it is attached to the pants 100 with the conventional inside of the pocket facing outward.

Figure 3:
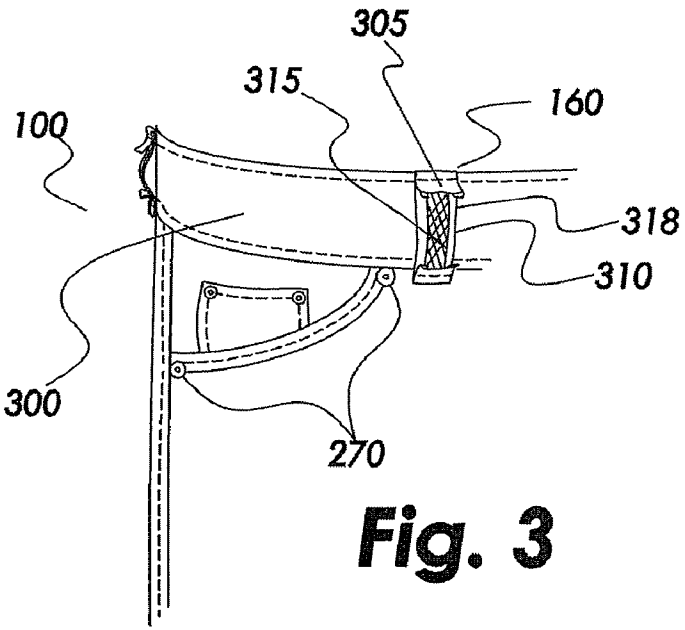
FIG. 3 depicts another close up view of the top of the pair of pants of FIG. 1*a*.

Turning now to FIG. 3, waistband 300 displays a single chain stitch on the outside of pants 100 as would be found on the inside of the waistband of conventional denim pants. Waistband 300 in the illustrated embodiment shows the right side of fabric. Exposing the right side of the fabric in waistband 300 is useful to, among other things, highlight the outline of waistband 300 as well as to provide visual contrast. In addition, because the waistband 300 displays the right side of the fabric it creates the illusion of having been created by simply turning a pair of conventional pants inside-out. In other embodiments, waistband 300 can be attached to pants 100 showing the wrong side of the fabric. In some embodiments waistband 300 can display stitching on the outside similar to the outside of a conventional pair of pants. In other embodiments waistband 300 can display stitching on the inside similar to the inside of a conventional pair of pants. In other embodiments, waistband stitching can include single chain stitching, double chain stitching, or any other types of stitching.

Belt carriers 160 are shown in the illustrated embodiment sewn onto the outside of waistband 300. Belt carriers 160 are formed by folding strips of fabric over itself and sewn onto waistband 300 forming a pair of belt carrier tabs 305 and belt carrier loop 318 located between belt carrier tabs 305. Belt carriers in the illustrated embodiment are made having the wrong side of fabric shown on the outside of pants 100 creating the appearance of an inside-out pair of pants. In addition, belt carrier tab 305 is shown oriented away from waistband 300 such that belt carrier loop 318 is located between waistband 300 and belt carrier tab 305 in contrast to a conventional pair of pants where belt carrier tab 305 would be oriented toward waistband 300 with belt carrier tab 305 being located between belt carrier loon 318 and waistband 300. Orienting belt carrier tabs 305 away from the waistband also contributes to the inside-out appearance. In other embodiments, carrier tab 305 can be oriented toward waistband 300. In still other embodiments, belt carriers 160 can be provided using the same configuration as found on a conventional pair of pants wherein the right side of the fabric is shown on the outside of the pants and wherein carrier tab 305 is oriented towards waistband 300 and therefore hidden from view. Exposing the right side of the fabric in belt carriers 160 is useful to, among other things, highlight the outline of belt carriers 160 as well as to provide visual contrast. Although the belt carriers in this embodiment appear conventional, the pants maintain an overall appearance of inside-out and are not detracted by belt carriers in this embodiment. In still further embodiments, belt carriers 160 can be provided using a similar configuration as found on a conventional pair of pants wherein the right side of the fabric is shown on the outside of the pants but wherein carrier tab 305 is oriented away from waistband 300 and therefore hidden from view.

Belt carriers 160 are attached in the illustrated embodiment to allow for functionality and usability, such as for use with a belt, as contrasted to a conventional pair of pants turned inside-out wherein the belt carriers would be located on the inside of the pants thus impeding and/or preventing use of a belt. Carriers provided in this way permit normal use of pants 100 such that the pants may be readily worn by threading a belt through the carriers as can be done in a conventional pair of pants. As used herein, the term 'normal use' refers to, among other things, the use that is typical of a conventional pair of pants such that pockets, belt carriers, buttons, and zippers are readily accessible from the outside. For example, if a conventional pair of pants are turned inside-out it can be difficult and/or impossible to continue use of items such as pockets, belt carriers, buttons and zippers because these items have been turned towards the inside of the pants and are not readily accessible with a person's hands or fingers. To continue use of these items in a conventional pair of pants turned inside-out therefore requires changes in the normal use of the pants. Embodiments of the invention described herein, however, provide normal use of pants wherein pockets, belt carriers, buttons, and zippers can be readily accessible from the outside.

Carrier hem 310 is folded toward waistband 300 in the illustrated embodiment. In some embodiments, carrier hem 310 can be folded away from the waistband. Stitching 315 is added to the outside of belt carriers 160 to provide the appearance of a belt carrier hem folded away from waistband 300. Because belt carrier hems are normally configured towards waistband 300 and therefore hidden from view, providing stitching in this way mimics the appearance of a carrier hem folded away from the waistband and therefore contributes to the illusion of inside-out pants.

With regards to belt carriers, it will be understood that any combination of right side/wrong side fabric, orientation of carrier tabs towards or away from waistband, and/or additions of hem stitching, can be made within the scope of the invention.

Figure 4B:
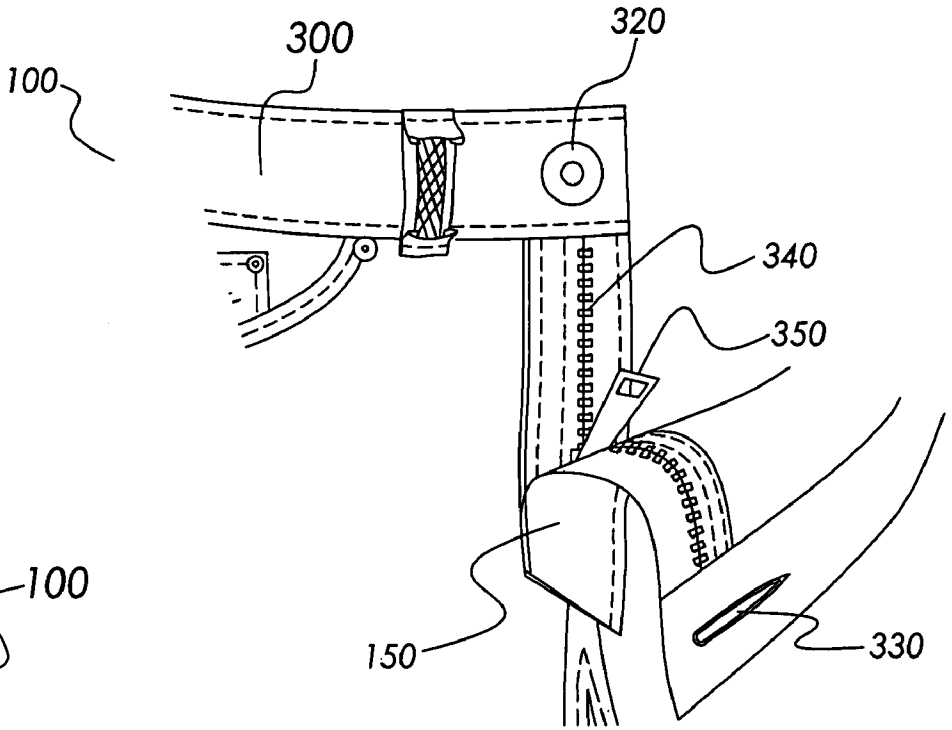
FIG. 4*b* depicts another close up view of the top of the pair of pants of FIG. 1*a*.
Figure 4A:
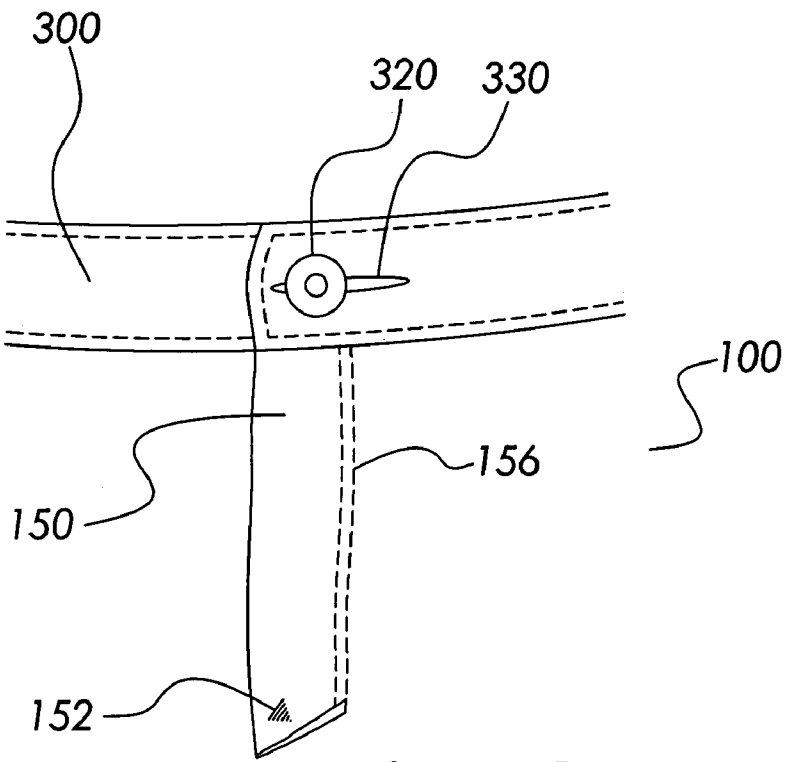
FIG. 4*a* depicts another close up view of the top of the pair of pants of FIG. 1*a*.

Turning now to FIGS. 4*a* and 4*b*, a close up view of the fly and button region of pants 100 is shown. Button 320 is attached to the outside of waistband 300 similar to buttons attached to conventional pairs of pants. Buttonhole 330 is created in the complementary side of the waistband to receive button 320. Button 320 and buttonhole 330 are positioned for functionality and usability so as to permit fastening of the pants around a person's waist as contrasted to a conventional pair of pants turned inside-out wherein the button would then be facing the inside of the pants, creating difficulties in fastening the pants. Buttons attached to pants as described herein thus provide for pants having the illusion of being inside-out but having the usefulness of a conventional pair of pants.

Fly guard 150, traditionally found on the inside of conventional pairs of pants, is exposed on the outside of the garment 100. The fly guard 150 is configured showing the right side of the fabric on the outside of pants 100 and is attached with bar tack 152 to hold fly guard 150 in place. In other embodiments fly guard 150 can be constructed showing the wrong side of fabric. Fly guard 150 is finished with serged seam 156. Because fly guard 150 displays the right side of fabric as well as the fly guard construction on the outside of pants 100, the illustrated embodiment provides the impression of a conventional pair of pants turned inside-out.

Zipper 340 is turned out in a normal manner and is attached to fly guard 150. Zipper 340 is positioned for functionality and usability such that zipper pull 350 can be used to open the fly of pants 100 as contrasted to a conventional pair of pants turned inside-out wherein the zipper pull would be located on the inside of the pants thus impeding and/or preventing use of the fly. Therefore, while the zipper of the pants 100 is positioned and used the same as a conventional pair of pants, placement of the fly guard on the outside of the pants 100 and having the right side of the fly guard fabric facing the outside of the pants 100 creates the impression of a conventional pair of pants turned inside out.

Other types of garments can be created using the invention as disclosed herein. For example, blouses and jackets could be made having seams and fabric constructed to provide an inside-out appearance while maintaining the functionality of a blouse or jacket having fasteners such as buttons which are oriented to the outside of the inside-out appearing garment. Some garments could also be made using non-traditional attachment methods as described above.

While the invention has been illustrated and described in detail in the drawings and foregoing description, the same is to be considered as illustrative and not restrictive in character. Only certain embodiments have been shown and described, and all changes, equivalents, and modifications that come within the spirit of the invention described herein are desired to be protected. Any experiments, experimental examples, or experimental results provided herein are intended to be illustrative of the present invention and should not be considered limiting or restrictive with regard to the invention scope. Further, any theory, mechanism of operation, proof, or finding stated herein is meant to further enhance understanding of the present invention and is not intended to limit the present invention in any way to such theory, mechanism of operation, proof, or finding. Thus, the specifics of this description and the attached drawings should not be interpreted to limit the scope of this invention to the specifics thereof. Rather, the scope of this invention should be evaluated with reference to the claims appended hereto. In reading the claims it is intended that when words such as "a", "an", "at least one", and "at least a portion" are used there is no intention to limit the claims to only one item unless specifically stated to the contrary in the claims. Further, when the language "at least a portion" and/or "a portion" is used, the claims may include a portion and/or the entire items unless specifically stated to the contrary. Finally, all publications, patents, and patent applications cited in this specification are herein incorporated by reference to the extent not inconsistent with the present disclosure as if each were specifically and individually indicated to be incorporated by reference and set forth in its entirety herein.

What is claimed is:

1. A pair of jeans having an inside and an outside wherein the outside of the jeans approximate an appearance of a conventional pair of jeans turned inside-out, the pair of jeans comprising:

a twill fabric comprising a plurality of warp yarns and a plurality of weft yarns, wherein the plurality of warp yarns are dyed and wherein the twill fabric is woven such that the weft yarns are prominent on one side and the warp yarns are prominent on the other side;

a plurality of pattern pieces formed from the twill fabric and attached together to substantially form the pair of jeans, the twill fabric having a right side in which the warp yarns predominate and a wrong side in which the weft yarns predominate;

a pair of pant legs;

a front pocket; and wherein the wrong side of a majority of the pattern pieces face the outside of the pair of jeans;

wherein the front pocket is attached to the pants and has a front pocket hem turned to the outside of the jeans, the front pocket hem displaying the right side of the twill fabric on the outside of the pair of jeans.

2. The pair of jeans of claim 1 further comprising a plurality of rivets, wherein the front pockets are attached with the rivets and wherein the rivets display the back side of the rivets normally hidden from view on the inside of a conventional pair of pants.

3. The pair of jeans of claim 1, further comprising a coin pocket constructed of the twill fabric wherein the coin pocket is attached showing the wrong side of the twill fabric on the outside of the jeans.

4. The pair of jeans of claim 3 further comprising:

a coin pocket hem turned to the outside of the jeans, the coin pocket hem exposing the right side of the twill fabric.

5. The pair of jeans of claim 3 further comprising a plurality of rivets, wherein the coin pocket is attached with the rivets and wherein the rivets display the back side of the rivets normally hidden from view on the inside of a conventional pair of pants.

6. The pair of jeans of claim 1, further comprising:

a plurality of rivet assemblies comprising a rivet back and a rivet front;

wherein the rivet front includes a front side and a rear side, wherein the rear side approximates the appearance of the rivet back;

wherein the front pocket is attached with the rivet assemblies; and wherein the rivet front faces the outside of the pair of pants; and wherein the rivet front is installed backward on the rivet back such that the rear side of the rivet front faces the outside of the pair of pants and the front side of the rivet front faces the rivet back.

7. The pair of jeans of claim 1, further comprising:

a fly zipper attached to the jeans and oriented to permit normal use of the fly zipper when the pair of jeans are worn with the appearance approximating the conventional pair of jeans turned inside-out, wherein the fly zipper has a front side and a back side and wherein the fly zipper is operable from only the front side.

8. The pair of jeans of claim 1 further comprising:

a back pocket hem turned to the outside of the jeans, the back pocket hem exposing the right side of the twill fabric.

9. The pair of jeans of claim 1, further comprising:

a waistband;

a belt carrier comprising a strip of the twill fabric, wherein the strip is folded over itself to form a belt carrier tab and a belt carrier loop;

wherein the belt carrier is attached to the waistband with the belt carrier tab oriented away from the waistband such that the belt carrier loop is located between the waistband and the belt carrier tab and wherein the belt carrier tab is visible to the outside.

10. A pair of jeans having an inside and an outside wherein the outside of the jeans approximate an appearance of a conventional pair of jeans turned inside-out, the pair of jeans comprising:

a twill fabric comprising a plurality of warp yarns and a plurality of weft yarns, wherein the plurality of warp yarns are dyed and wherein the twill fabric is woven such that the weft yarns are prominent on one side and the warp yarns are prominent on the other side;

a plurality of pattern pieces formed from the twill fabric and attached together to substantially form the pair of jeans, the twill fabric having a right side in which the warp yarns predominate and a wrong side in which the weft yarns predominate;

a pair of pant legs;

a back pocket; and a back pocket hem turned to the outside of the jeans, the back pocket hem exposing the right side of the twill fabric;

wherein the wrong side of a majority of the pattern pieces face the outside of the pair of jeans;

wherein the pant legs substantially display the wrong side of the twill fabric on the outside; and wherein the back pocket is a patch pocket constructed of the twill fabric attached showing the wrong side of the twill fabric on the outside of the jeans.

11. The pair of jeans of claim 10, further comprising:

a waistband;

a belt carrier comprising a strip of the twill fabric, wherein the strip is folded over itself to form a belt carrier tab and a belt carrier loop;

wherein the belt carrier is attached to the waistband with the belt carrier tab oriented away from the waistband such that the belt carrier loop is located between the waistband and the belt carrier tab and wherein the belt carrier tab is visible to the outside.

12. A pair of jeans having an inside and an outside wherein the outside of the jeans approximate an appearance of a conventional pair of jeans turned inside-out, the pair of jeans comprising:

a twill fabric comprising a plurality of warp yarns and a plurality of weft yarns, wherein the plurality of warp yarns are dyed and wherein the twill fabric is woven such that the weft yarns are prominent on one side and the warp yarns are prominent on the other side;

a plurality of pattern pieces formed from the twill fabric and attached together to substantially form the pair of jeans, the twill fabric having a right side in which the warp yarns predominate and a wrong side in which the weft yarns predominate;

a pair of pant legs;

a waistband;

a belt carrier comprising a strip of the twill fabric, wherein the strip is folded over itself to form a belt carrier tab and a belt carrier loop;

wherein the belt carrier is attached to the waistband with the belt carrier tab oriented away from the waistband such that the belt carrier loop is located between the waistband and the belt carrier tab and wherein the belt carrier tab is visible to the outside;

wherein the wrong side of a majority of the pattern pieces face the outside of the pair of jeans;

wherein the pant legs substantially display the wrong side of the twill fabric on the outside.

13. The pair of jeans of claim 12, wherein the belt carrier substantially displays the wrong side of the twill fabric.

14. The pair of jeans of claim 12, wherein the belt carrier substantially displays the right side of the twill fabric.

15. A pair of jeans having an inside and an outside wherein the outside of the jeans approximate an appearance of a conventional pair of jeans turned inside-out, the pair of jeans comprising:

a twill fabric comprising a plurality of warp yarns and a plurality of weft yarns, wherein the plurality of warp yarns are dyed and wherein the twill fabric is woven such that the weft yarns are prominent on one side and the warp yarns are prominent on the other side;

a plurality of pattern pieces formed from the twill fabric and attached together to substantially form the pair of jeans, the twill fabric having a right side in which the warp yarns predominate and a wrong side in which the weft yarns predominate;

a pair of pant legs;

a front pocket; and a front pocket bag constructed of a conventional pocket bag fabric, wherein the conventional pocket bag fabric has a different appearance than the twill fabric;

wherein the wrong side of a majority of the pattern pieces face the outside of the pair of jeans;

wherein the front pocket bag is at least partially visible on the outside of the jeans; and wherein the front pocket bag is at least partially concealed on the inside of the jeans.

16. The pair of jeans of claim 15, wherein the front pocket is attached to the pants and has a front pocket hem turned to the outside of the jeans, the front pocket hem displaying the right side of the twill fabric on the outside of the pair of jeans.

17. The pair of jeans of claim 16, further comprising:

a coin pocket hem turned to the outside of the jeans, the coin pocket hem exposing the right side of the twill fabric.

18. The pair of jeans of claim 15, further comprising:

a fly zipper attached to the jeans and oriented to permit normal use of the fly zipper when the pair of jeans are worn with the appearance approximating the conventional pair of jeans turned inside-out, wherein the fly zipper has a front side and a back side and wherein the fly zipper is operable from only the front side.

19. The pair of jeans of claim 15 further comprising:

a back pocket hem turned to the outside of the jeans, the back pocket hem exposing the right side of the twill fabric.

20. The pair of jeans of claim 15, further comprising:

a coin pocket hem turned to the outside of the jeans, the coin pocket hem exposing the right side of the twill fabric.

21. The pair of jeans of claim 15, further comprising:

a plurality of rivets, wherein the front pockets are attached with the rivets and wherein the rivets display the back side of the rivets normally hidden from view on the inside of a conventional pair of pants.

22. The pair of jeans of claim 15, further comprising:

a plurality of rivet assemblies comprising a rivet back and a rivet front;

wherein the rivet front includes a front side and a rear side, wherein the rear side approximates the appearance of the rivet back;

wherein the front pocket is attached with the rivet assemblies; and wherein the rivet front faces the outside of the pair of pants; and wherein the rivet front is installed backward on the rivet back such that the rear side of the rivet front faces the outside of the pair of pants and the front side of the rivet front faces the rivet back.

23. The pair of jeans of claim 15, further comprising:

a waistband;

a belt carrier comprising a strip of the twill fabric, wherein the strip is folded over itself to form a belt carrier tab and a belt carrier loop;

wherein the belt carrier is attached to the waistband with the belt carrier tab oriented away from the waistband such that the belt carrier loop is located between the waistband and the belt carrier tab and wherein the belt carrier tab is visible to the outside.

* * * * *

UNITED STATES PATENT AND TRADEMARK OFFICE

CERTIFICATE OF CORRECTION

PATENT NO. : 7,350,242 B2
APPLICATION NO. : 11/429036
DATED : April 1, 2008
INVENTOR(S) : Elizabeth M. Girod It is certified that error appears in the above-identified patent and that said Letters Patent is hereby corrected as shown below:

On Page 1 of the Patent Cover under References cited, patent document 6,182,296 to Hosogai, remove the "*" designation.

Signed and Sealed this

Seventeenth Day of June, 2008

JON W. DUDAS
*Director of the United States Patent and Trademark Office*